US010655236B2

(12) United States Patent
Prado Pueo

(10) Patent No.: US 10,655,236 B2
(45) Date of Patent: May 19, 2020

(54) ELECTRODE STRUCTURE FOR THE ELECTRODEPOSITION OF NON-FERROUS METALS

(71) Applicant: INDUSTRIE DE NORA S.P.A., Milan (IT)

(72) Inventor: Felix Prado Pueo, Monzon (ES)

(73) Assignee: INDUSTRIE DE NORA S.P.A., Milan (IT)

( * ) Notice: Subject to any disclaimer, the term of this patent is extended or adjusted under 35 U.S.C. 154(b) by 0 days.

(21) Appl. No.: 15/738,820

(22) PCT Filed: Jun. 30, 2016

(86) PCT No.: PCT/EP2016/065398

§ 371 (c)(1),
(2) Date: Dec. 21, 2017

(87) PCT Pub. No.: WO2017/001612

PCT Pub. Date: Jan. 5, 2017

(65) Prior Publication Data

US 2018/0179652 A1 Jun. 28, 2018

(30) Foreign Application Priority Data

Jul. 1, 2015 (IT) ..... 102015000029661

(51) Int. Cl.
*C25C 7/06* (2006.01)
*C25C 1/12* (2006.01)
(Continued)

(52) U.S. Cl.
CPC ..... *C25C 7/06* (2013.01); *C25C 1/12* (2013.01); *C25C 7/02* (2013.01); *C25D 17/12* (2013.01); *C25D 21/12* (2013.01)

(58) Field of Classification Search
CPC ..... C25C 7/06
See application file for complete search history.

(56) References Cited

U.S. PATENT DOCUMENTS

2002/0002414 A1* 1/2002 Hsiung ..... G05B 15/02 700/95
2006/0213766 A1 9/2006 You
2010/0276281 A1* 11/2010 Sandoval ..... C25C 7/02 204/288

FOREIGN PATENT DOCUMENTS

WO 2011/123896 A1 10/2011
WO 2012/020243 A1 2/2012
(Continued)

OTHER PUBLICATIONS

International Search Report and Written Opinion for International Application No. PCT/EP2016/065398 (dated Aug. 3, 2016) (11 Pages).

(Continued)

*Primary Examiner* — Nicholas A Smith
(74) *Attorney, Agent, or Firm* — Lucas & Mercanti, LLP

(57) ABSTRACT

The present invention relates to an electrode structure which can detect the electric current and optionally activate alarm signals in electrolytic cells for the electrodeposition of non-ferrous metals, for example for electrowinning of metals, in particular for the electrolytic production of copper and other non-ferrous metals proceeding from ionic solutions. The present invention further relates to a data acquisition system to be used in connection with said electrode structure.

19 Claims, 2 Drawing Sheets

(51) Int. Cl.

| | |
|---|---|
| ***C25C 7/02*** | (2006.01) |
| ***C25D 21/12*** | (2006.01) |
| ***C25D 17/12*** | (2006.01) |

(56) References Cited

FOREIGN PATENT DOCUMENTS

| | | | |
|---|---|---|---|
| WO | 2014/032084 | A1 | 3/2014 |
| WO | 2014/131946 | A1 | 9/2014 |
| WO | 2014/195572 | A1 | 12/2014 |
| WO | 2014/202592 | A1 | 12/2014 |
| WO | 2015/079072 | A2 | 6/2015 |

OTHER PUBLICATIONS

International Preliminary Report on Patentability for International Application No. PCT/EP2016/065398 (dated Jun. 21, 2017) 12 Pages).

* cited by examiner

ELECTRODE STRUCTURE FOR THE ELECTRODEPOSITION OF NON-FERROUS METALS

This application is a U.S. national stage of PCT/EP2016/065398 filed on Jun. 30, 2016 which claims the benefit of priority from Italian Patent Application No. 102015000029661 filed Jul. 1, 2015 the contents of each of which are incorporated herein by reference.

SCOPE OF THE INVENTION

The present invention relates to a system for detecting, and optionally monitoring, the current in electrolytic cells for plants for electrorefining, electroplating or electrowinning of non-ferrous metals.

BACKGROUND OF THE INVENTION

In electrodeposition plants, particularly in plants for the electrorefining, electroplating or electrowinning of non-ferrous metals, production and the quality of the metal produced depend, among other things, on the density and distribution of electric current in the electrodes of each elementary cell of the electrolysers.

In particular, one of the main factors that can affect the efficiency and quality of production is related to the occurrence of irregularities in the electric current distribution in the electrodes, due to situations of overcurrent or anomalous current reductions. For example, in plants for the electrowinning of metals, the cathodes of each elementary cell have to be removed from their seats periodically for the metal collection operations. These frequent movements may result in imperfect electrical contacts after the electrodes have been repositioned in their seats, causing irregularities in the distribution of the supply current in the electrodes, and consequently reducing production quality and efficiency. It must also be borne in mind that the deposition of metal on the electrode sometimes takes place in a non-uniform way, resulting in anomalies in the electric current distribution. An example of this phenomenon can be seen in the case of copper electrowinning, where greater metal deposition is frequently found in the lower and/or lateral portion of the cathode. Another situation which may give rise to large irregularities in current distribution is related to the growth of dendritic formations on the electrodes, as found, in particular, in the processes of electrowinning of copper, cadmium or zinc. When these dendritic formations come into contact with the facing electrode, they may create electrical short circuit situations which can seriously compromise metal production, by drawing supply current away from the other electrodes of the electrolyser, possibly causing irreparable damage to the electrodes involved in the short circuit.

In order to control the situations of irregular current distribution described above, current alarm and monitoring devices are sometimes used in metal electrorefining, electroplating and electrowinning plants. These devices are typically positioned on the electrode structure (on the electrode hanger bar, for example) or on the corresponding power supply busbar; alternatively, they may be located near the electrochemical cells, by being suspended or placed adjacent to them. In the latter case, the accurate and reliable identification of the current flowing through the electrode is greatly complicated by the fact that signals of different origin reach the device simultaneously, the analysis of these signals requiring the use of complex mathematical models.

This complexity has the practical effect of making it difficult to detect in a reliable manner the small current signal variations due to irregularities in the current distribution.

On the other hand, if the current alarm and monitoring device is positioned on the cathode or anode structure, the power supply to the device has critical elements which have an impact on its practical use. The presence of power supply wires directly on the electrode structure is highly undesirable, owing to the corrosive environment in which they are located, which may cause rapid deterioration of the wires (possibly even creating naked flames, with obvious consequences for the safety of the plant). The presence of wires may also impede the metal collection operations, or in any case the access to the electrodes, and therefore constitutes a hazard or at least an inconvenience for the plant operators. The use of batteries or other energy storage means, with a limited service life, overcomes the problems of power supply caused by the presence of wires, but is not a satisfactory solution, because of the implications in terms of maintenance: the operations of checking and replacing the batteries of the device in an electrowinning plant for the purpose of ensuring their correct and reliable operation would have to be performed frequently on a large number of electrodes and in unhealthy environmental conditions, causing discomfort for the plant personnel.

It is therefore desirable to provide a solution for the aforementioned problems, for example in the form of electrode structures for non-ferrous metal electrorefining, electroplating or electrowinning plants having an electric current alarm and detection device which requires few maintenance operations, has a guaranteed service life of several years, and provides simple and reliable electric current signal detection.

It should also be noted that, according to the operating parameters of the plant, the occurrence of situations of overcurrent or other irregularities in electric current distribution is frequently associated with low signal variations which may be difficult to discriminate from the variations due to signal noise. It is therefore desirable to provide a current signal acquisition and processing system such that its reliability and efficiency are maximized, to be used in combination with electric current alarm and monitoring devices capable of detecting the current signal directly on the electrode structure.

SUMMARY OF THE INVENTION

The present invention relates to a system for detecting the electric current flowing in an electrode of an electrolytic cell for non-ferrous metal electrorefining, electroplating or electrowinning, optionally having the capacity to alert the plant personnel in situations of electric overcurrent or other irregularities in current distribution. In particular, the present invention can allow the rapid identification of electrodes subject to any electrical short circuit, which may be caused, for example, by the growth of dendrites, by irregularities in metal deposition, or by possible mechanical incidents that may put the anodes and cathodes directly in electrical contact with each other.

The present invention also relates to an electric current detection system which has sufficient power supply life to ensure maintenance-free operation for a period of several years, and which can withstand the corrosive environment of non-ferrous metal electrorefining, electroplating or electrowinning plants.

The present invention also relates to a current detection system providing reliable reading of the current flowing in an electrode, made in such a way as to reduce the contributions to the detected signal originating from neighbouring electrodes and/or from other current supply means.

The present invention also relates to a data acquisition system for measuring the electric current in non-ferrous metal electrowinning plants which can accurately identify the small signal variations associated with the occurrence of situations of overcurrent or irregularity of current distribution, when said system is used in conjunction with the aforementioned current detection system.

Various aspects of the present invention are disclosed in the attached claims.

In one aspect, the invention relates to an anode structure for metal electrodeposition, comprising an anode, an anode hanger bar for supporting the anode, and at least one wireless integrated device, wherein the latter device comprises the following elements: wireless communication means, at least one electric current sensor for the direct or indirect detection of the current flowing through said anode hanger bar, an electrical energy storage system, and a microcontroller (also known as an MCU). The wireless integrated device is subject to a periodic actuation cycle comprising a standby mode and an activation mode, in which the standby mode has a total duration of 90.000%-99.998% of the duration of each periodic actuation cycle.

The anode may be made of any material and may have any structure suitable for the electrorefining, electrodeposition or electrowinning of non-ferrous metals; for example, the anode may be made of lead or a valve metal such as titanium. The anode may be catalytically activated and may be modelled from solid sheets, grids or lattices, in slotted, porous or perforated structures.

The term "wireless integrated device" denotes an electric current detection device which has no exposed external wires for powering the device, for communication with other devices, or for alarm activation. The device is incorporated in, fastened to, glued to or sealed on the anode structure, preferably on the anode hanger bar.

The term "wireless communication means" denotes a system for transmitting, and possibly receiving, electromagnetic waves such as radio waves or microwaves. Wireless communications standards such as Bluetooth, Wi-Fi, ZigBee, 3G or GSM may be used for this purpose.

The term "electrical energy storage system" denotes at least one device, for example a battery or a plurality of batteries, which supplies the wireless integrated device in the absence of a connection to an external power supply system. The electrical energy storage system supplies all the elements of the integrated device which require an electricity supply, such as the microcontroller. The microcontroller is a unit that controls the periodic actuation cycle according to the invention. This periodic actuation cycle, in which the integrated device is mainly put in a standby mode, may have the benefit of preserving the life of the electrical energy storage system, providing an operating life of more than one year.

The term "standby mode" denotes a mode with low electrical energy consumption. In this standby mode, the electrical energy consumption by the wireless integrated device, in particular the microcontroller, is reduced to the minimum necessary for supplying: a) a chronometer which sets the duration of the standby and actuation periods, and b) all the subsystems for preserving the data contained in the RAM and for restarting the operation of the microcontroller after a wake-up signal supplied by the clock.

The electric current sensor may be, for example, a temperature sensor or a Hall sensor. The latter is known in the art for being capable of providing an indirect measurement of the current flowing in the anode structure via the measurement of the Hall effect induced by the magnetic field generated by the current flowing through the anode hanger bar.

The temperature variations measured on the anode hanger bar provide a further or alternative indication of the occurrence of irregularities in the distribution of electric current in the elementary electrochemical cell. The temperature sensor may be chosen from among the following devices: thermocouples, thermistors, thermoresistors or other commercially available electronic integrated devices capable of producing voltage signals proportional to temperature. However, a person skilled in the art will recognize that any temperature sensor suitable for use for the purpose specified in the present description may be used without departure from the scope of the invention.

In one embodiment, the anode structure according to the invention comprises an anode hanger bar which is handlebar-shaped, or in other words is formed, in the vertical plane, by a lower horizontal main portion and two horizontal upper side portions connected to opposite sides of said horizontal main portion through two slanted intermediate portions, the wireless integrated device being positioned on the top surface of one of the two slanted intermediate portions. The handlebar shape of the anode hanger bar can facilitate access to the cathode hanger bars when the cathodes are removed from their seats for metal collection operations.

The term "horizontal" referring to the portions of the anode hanger bar described herein denotes a generally horizontal geometry in the vertical plane. This definition includes curved bodies with a small radius of curvature, or bodies which are horizontal within a margin of error of 20% or less in the vertical direction.

In all cases in which the wireless integrated device comprises a Hall sensor, the first may be positioned in such a way that said sensor is located on the upper third section of one of the two slanted intermediate portions, where the two slanted intermediate portions form an angle of 20-70 degrees with the vertical. This positioning of the Hall sensor, which corresponds approximately, in the vertical plane, to the mean height of the cathode hanger bar, may provide the benefit of reducing the contributions of the magnetic field signal originating from the adjacent electrodes, particularly the contribution of the signal originating from the cathode hanger bar facing the anode structure according to the invention.

In another embodiment, the wireless integrated device of an anode structure according to the invention has a periodic actuation cycle with a total duration of 1-15000 seconds. During each periodic actuation cycle, the microcontroller may activate, at predefined time intervals, at least one electric current sensor, such as a temperature sensor or a Hall sensor, which measures the current signal on the anode hanger bar.

The microcontroller may also activate, at predefined time intervals, the wireless communication means which send the data relating to the electric current measurement made by the sensor or sensors to at least one receiving means. The number of times that the wireless communication means are activated may advantageously be chosen to be equal to or less than the number of times that the electric current sensor is activated during each cycle, in order to reduce the consumption of energy from the electrical energy storage system. The receiving means may be positioned near the electrodes at a distance which is preferably less than 100 m, or preferably at a distance of 15 cm-20 m, or more preferably at 1-8 m, and may be programmed to collect the data sent by the anode structures according to the invention. For example, each receiving means may be programmed to collect data from at least one anode structure, preferably from 2 to 20 anode structures, or even more preferably 2-10 anode structures. Each receiving means may be connected to a local computer having further means of communication. The data collected by the receiving means may be pre-processed by the local computers and then sent by the further communication means to a central computer, by wireless or wire means. This two-step communication system (the first step being from the anode structure to a local computer and the second being from each local computer to a central computer) may provide the benefit of simplifying the signal processing operations, by reducing the distance travelled by the signals, making it possible to establish a hierarchy between the various signals, and optionally pre-processing them, thus providing more efficient and reliable data management. The central computer may subsequently perform further processing on the data received from the local computers, and provide reports on the activity of the plant, monitor the presence of irregularities in current distribution, and activate alarm means if necessary. In small and medium-sized copper electrowinning plants, the number of signals to be processed may easily be more than 1000, and is typically equal to or greater than 5000. In these cases, the two-step communication system described above may advantageously be used to organize the flow of data from the anode structures in an efficient and reliable way.

In a further embodiment, the periodic actuation cycle has a duration of 300-6000 seconds, the microcontroller activates the electric current sensor or sensors, for example a Hall sensor or a temperature sensor, from 1 to 10 times during each periodic actuation cycle, and each activation has a duration of less than 15 milliseconds, preferably from 6 to 8 milliseconds. The microcontroller may activate the wireless communication means 1-3 times during each periodic actuation cycle. This embodiment may have the advantage of conserving the load of the electrical energy storage system for a period of up to 10 years.

In a further embodiment, the anode structure according to the invention further comprises visual alarm means, such as signal lamps or LEDs, and/or acoustic alarm means. These alarm means may be activated directly by the microcontroller of the wireless integrated device, or, preferably, by other computer devices which, at the time of reception of the current measurement by the integrated device, analyse the signals to evaluate the presence of irregularities in current distribution. This evaluation may be performed, for example, by comparing the current measured on the anode structure at a predefined range of nominal values. To increase the reliability of any alarm, the alarm means may be activated after a predetermined number of measurements confirms the existence of the irregularity of the detected signal. Alternatively, a statistical analysis can be performed on the current signals detected by a single anode structure or by a predetermined set of anode structures, over time. This analysis can be used to monitor any variations in time of the mean current value of an anode structure and/or the relative velocity of these variations (using the first derivative function), by comparing these values with a range of predefined values, and/or to monitor these variations with respect to the values detected by a predetermined number of adjacent anode structures, by comparing these values with each other or with a range of predefined values.

In addition, or as an alternative, to the analytical methods described above, digital filters can be applied to one or more functions of the electric current detected in time (i.e. the mean current and/or the standard deviation from the mean). The use of filters on the current functions may help to increase the accuracy and reliability of the identification of actual irregularities in the electric current distribution, by reducing the signal fluctuations due to transient variations. For this purpose, the use of first order digital filters, such as moving average filters, particularly exponential moving average filters, has been successfully tested by the inventors. The filtered variable can be compared with a range of acceptable values and can activate an alarm if it falls outside said range.

In all the cases described above, the wireless integrated device may be covered with corrosion-resistant materials, such as plastics or resins, to help preserve it over time. The use of heat shrink films to enclose and protect the components of the wireless integrated device may provide the benefit of allowing access to the components of the device if necessary. Heat shrink films may be made of polymer materials, such as polyolefin, capable of withstanding the corrosive environment of electrochemical plants. Alternatively, the integrated device may be embedded in a resin or plastic matrix which can provide particularly durable protection.

In another aspect, the present invention relates to a wireless integrated device comprising: i) a microcontroller, ii) an electrical energy storage system, iii) at least one electric current sensor for measuring electric current (for example, a Hall sensor and/or a temperature sensor), and iv) wireless communication means, wherein said device is powered by the electrical energy storage system and is subject to a periodic actuation cycle comprising a standby mode and an activation mode, in which said standby mode has a total duration of 90.000%-99.998% of the duration of each periodic actuation cycle, and in which each said cycle may have a duration of 1-15000 seconds. During each cycle, the microcontroller activates the electric current sensor and the wireless communication means at predefined time intervals. In some cases, it may be desirable to activate the electric current sensor more frequently than the wireless communication means, since the latter have a higher electrical energy consumption than the former.

In a further aspect, the present invention relates to a system for acquiring electric current signals in a metal electrodeposition plant, comprising at least one electrolyser equipped with a plurality of elementary electrolytic cells, wherein each elementary electrolytic cell is equipped with a cathode and an anode structure according to the invention, and at least one computer wirelessly connected to at least one anode structure. Said at least one computer may be a local computer wirelessly connected to 2-20 said anode structures and capable of receiving, processing and transmitting information from each wireless integrated device to a central computer. The data acquisition system may also comprise at least one alarm device providing a visual and/or acoustic alarm that can be activated from the local or central computer. The activation of said at least one alarm device by a central computer or by a local computer may take place according to the following steps: i) acquisition and storage by the central computer or by the local computer of the data sent by each anode structure connected to the local or central computer, said data comprising at least one function of the electric current signal, ii) application of a linear filter to the function of electric current, iii) activation of the alarm device if the filtered value of the function of the electric current signal lies outside a predetermined range of values. The linear filter may be a moving average filter, for example an exponential moving average filter. It has been observed that this filter is particularly suitable for the analysis of the signals of electric current flowing in an anode structure of a copper electrowinning plant, particularly in the case of overcurrent caused by the growth of dendrites on the facing cathode.

The data sent by each anode structure to the computer are time series data, since they are the result of successive measurements made in a time interval. The linear filter may be applied to eliminate the noise in the temporal variation of the data. For this purpose, the function of electric current to be filtered may be indexed by the local or central computer as a function of the cycle, or of the instant of time, in which the direct or indirect signal of electric current was detected.

The term "function of the electric current signal" denotes a mathematical function of the electric current function, for example a linear function of the deviation of the electric current of an anode structure from the mean current value, where the mean current value can be defined as the mean current value of a set of anode structures analysed by the local and/or central computer. This deviation of the electric current may be normalized with respect to the mean current value and expressed as a percentage.

It may be advantageous to synchronize the metal collection operations with the actuation cycle of the wireless integrated device, so as to execute the whole collection operation when the integrated device is in standby mode. This makes it possible to reduce the computer load for monitoring anomalous current signals when the cathodes are removed from their seats during the metal collection operations.

Some exemplary embodiments of the invention will now be described with reference to the attached drawings, which have the sole purpose of illustrating the mutual arrangement of the various elements in said particular embodiments of the invention; in particular, the drawings are not necessarily to scale.

DETAILED DESCRIPTION OF THE DRAWINGS

Figure 1:
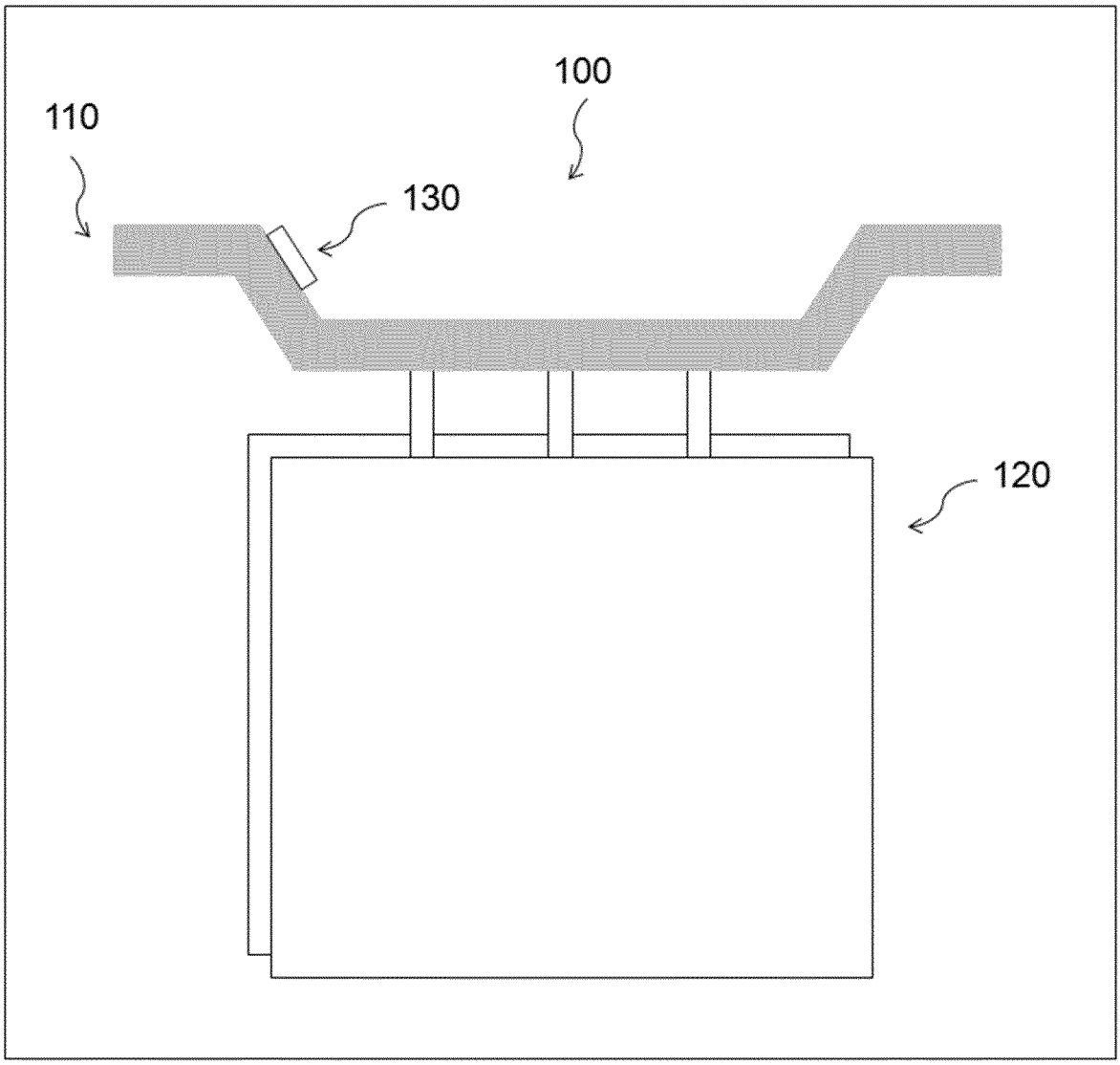
FIG. 1 is a schematic illustration of an anode structure according to one embodiment of the invention.

FIG. 1 is a schematic illustration of an anode structure (100), comprising an anode hanger bar (110) which mechanically supports an anode (120). The anode hanger bar is also equipped with the wireless integrated device (130).

Figure 2:
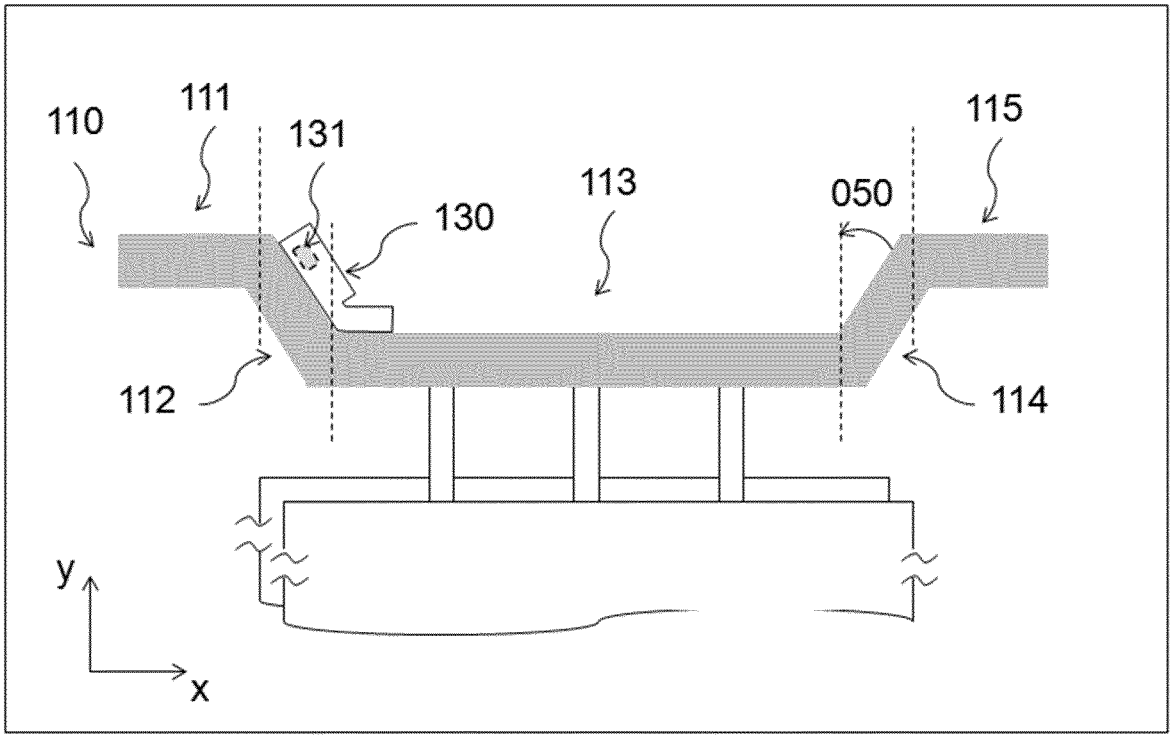
FIG. 2 is a schematic illustration of geometrical sections of the anode hanger bar of the anode structure according to one embodiment of the invention.

FIG. 2 is a schematic illustration of the geometric structure of the anode hanger bar (110) according to one embodiment of the invention. The anode hanger bar (110) can be schematically divided into five geometrical portions in the vertical plane xy, namely two upper and substantially horizontal lateral portions (111) and (115), a lower horizontal main portion (113) and two slanted intermediate portions (112) and (114) which connect the lower horizontal main portion to the portions (111) and (115) respectively. The slanted intermediate portion (114) forms an angle (050) with the vertical. This angle is typically in the range from 20 to 70 degrees. The two upper lateral portions can be positioned above the current-carrying busbar and/or a balance bar, if present, of the electrolyser (not shown). The figure schematically illustrates the wireless integrated device (130) positioned on the top surface of the slanted intermediate portion (112) and extending on to the lower horizontal main part. The wireless integrated device (130) houses a Hall sensor (131) located in the upper third section of the slanted intermediate portion.

The following example is included to demonstrate a particular embodiment of the invention, the applicability of which has been clearly verified within the claimed range of values. A person skilled in the art should appreciate that the compositions and methods described in the following example represent compositions and methods which the inventors have found to operate satisfactorily in practice; however, a person skilled in the art should appreciate, in the light of the present description, that many changes may be made to the specific embodiments disclosed, while still obtaining similar or analogous results, without departure from the scope of the invention.

EXAMPLE

An accelerated test programme was carried out in an industrial electrolyser for copper electrowinning, comprising 64 elementary cells, each cell containing a cathode and an anode structure. The cathode consisted of a stainless steel sheet with a surface area of 1240×830 mm, while the anode consisted of a lead sheet having an equal surface area. The cathode and the anode were positioned vertically, facing each other, at a distance of 50 mm between the outer surfaces. The anode hanger bar was made of copper and was handlebar-shaped, with a cross section of 24×43 mm, and covered with a corrosion-resistant resin.

The electrolyser was operated with an electrolyte containing 160 g/l of $H_2SO_4$ and 50 g/l of copper in the form of $Cu_2SO_4$, with a supply voltage of 2.1 V, corresponding to a nominal current density of 400 A/m$^2$, with oxygen evolution at the anode and copper deposition at the cathode.

The 64 anode structures of the electrolyser included 6 adjacent anode structures made according to the invention; each of the 6 anode structures comprised a wireless integrated device, with dimensions of 25 mm×14 mm×190 mm, positioned on the anode hanger bar as shown schematically in FIG. 2. All the integrated devices had been covered with a heat shrink polyolefin film.

Each wireless integrated device was powered by an electrical energy storage system consisting of two lithium batteries, namely a 190 mAh battery and a 90 mAh battery, connected in series. Each battery had a maximum permitted operation temperature of 85° C. and a loss of charge when idle of less than 1% per year.

The integrated devices comprises a Hall sensor with the following specifications: a linear response as a function of the magnetic field strength in the temperature range from −40° C. to 150° C., an energy consumption of about 7 mA and an "On-Off" switching time of 50 microseconds.

Each integrated device comprised a radio signal transmitter according to the ZigBee standard and a microcontroller. The microcontroller had a low energy consumption. In particular, the energy consumption varied according to its activation state as follows: i) standby mode with clock active (1.6 μA), ii) operating mode with radio off (7 mA), iii) operating mode with radio on (20 mA).

Each microcontroller was associated by the manufacturer with a MAC (Mean Access Control) address which provided a unique identifier of the wireless integrated device housing the microcontroller. During the installation of the integrated devices, all the MAC addresses were associated with the corresponding anode structure, and this relationship was then recorded on a computer.

The computer was equipped with receiving means and was put into communication with the 6 anode structures according to the invention.

Every 1.5 minutes, each microcontroller activated the Hall sensor, made the electric current measurement, and switched it off. The overall duration of the sensor activation state was about 70 microseconds per cycle. Every 1.5 minutes, each microcontroller sent the electric current measurements from the Hall sensor to the local computer by transmitting a radio signal. The time required by the microcontroller to send each data packet by radio was about 4 ms.

On the basis of the electric current data received from the computer, in each measurement cycle k the mean value of the current $IAVG_k$ of the 6 anode structures according to the invention was calculated according to the formula:

$$IAVG_k = 1/N\sum_{j=1}^{N} I_{j,k};$$

where $I_{j,k}$ was the value of the current in the anode structure j after measurement cycle k, and N was the number of anode structures according to the invention, equal to 6.

The deviation $DI_{j,k}$ of the anode current with respect to the mean $IAVG_k$ expressed as a percentage was calculated as:

$$DI_{j,k} = \frac{I_{j,k} - IAVG_{j,k}}{IAVG_{j,k}} \cdot 100;$$

An exponential moving average filter was used by applying the following algorithm to the variable $DI_{j,k}$, and the filtered variable $FDI_{j,k}$ was found by the following algorithm:

$$FDI_{j,k+1}=\alpha\cdot FDI_{j,k}+(1-\alpha)\cdot DI_{j,k+1};$$

where $$FDI_{j,1}=DI_{j,1}$$

The parameter $\alpha=\exp(-1/\tau)$ was set at 0.99875, on the basis of the inventors' observation that, for an average plant operation time of 100 hours, the substantial current irregularities typically occurred in the last 20 hours. With a cycle having a duration of 1.5 minutes, the time constant $\tau$ expressed as a number of cycles is $\tau=800=20\times3600/90$.

The transient variation $VDI_{j,k}$, expressed as:

$$VDI_{j,k}=DI_{j,k}-FDI_{j,k}$$

was compared with a predetermined value X=30. The algorithm was set to activate a visual alarm at the anode j in all cases in which $VDI_{j,k}>X$.

The electrolyser was kept in operation for 4 days. The analysis of the values of the electric current signal originating from the anode structures according to the invention, recorded on the computer, showed no anomalies, and no alarm signal was activated by the system. A visual inspection of the elements of the cells under investigation did not reveal the presence of any dendritic formations or non-homogeneous growths of the metal.

The copper deposited at the cathodes was collected, and the production quality and quantity were in line with expectations.

Before the cathodes were repositioned in their seats, a screw was inserted into a cathode perpendicularly to one of the anode structures according to the invention, to form an artificial dendrite, with the screw point at a distance of 4 millimetres from the anode.

The electrolyser was then put into operation for 4 days.

On the 3rd day of operation, a lateral growth of copper was observed on the dendrite, until the anode surface was reached.

After 20 minutes of contact, the presence of excess current was indicated on the computer screen in relation to the anode structure concerned, causing the illumination of an LED on the structure. The analysis of the data obtained during the experiment showed that an electric current increase of 60% for 92 minutes was recorded on the anode structure affected by the contact with the dendrite.

The accelerated test described above might indicate that the wireless integrated device had a service life of about one year. A person skilled in the art can understand that the power supply life of the integrated device can be increased by a factor of more than 10 by increasing the duration of the periodic actuation cycle (from 1.5 minutes to 15 minutes, for example), and by adjusting the number of times that the current sensor and the radio communication means are activated during each cycle.

The preceding description is not intended to limit the invention, which can be used according to various embodiments without thereby departing from the objects of the invention, the scope of the invention being defined solely by the attached claims.

In the description and claims of the present application, the word "comprise" and its variations such as "comprising" and "comprises" do not exclude the presence of other additional elements, components or process stages.

The discussion of documents, acts, materials, apparatus, articles and the like is included in the text for the sole purpose of providing a context for the present invention; however, it should not be considered that this material or any part of it constitutes general knowledge in the field relating to the invention before the priority date of each of the claims attached to the present application.

The invention claimed is:

1. An anodic structure for metal electrodeposition comprising:

an anode;

an anodic hanger bar supporting said anode; and at least one wireless integrated device, wherein said at least one wireless integrated device houses a wireless communication means, at least one electric current sensor for the direct or indirect detection of the current flowing through said anode hanger bar, an energy storage means and a microcontrol unit, said wireless integrated device exhibiting a periodic actuation cycle comprising a sleep mode and an activation mode, said sleep mode having a total duration corresponding to 90.000%-99.998% of the duration of each periodic actuation cycle, and wherein said anodic hanger bar comprises a lower horizontal main portion and two horizontal upper end portions connected to opposite sides of said horizontal main portion through two slanted intermediate portions, said at least one wireless integrated device being positioned on the top surface of either of said slanted intermediate portions.

2. The anodic structure according to claim 1, wherein each said periodic actuation cycle has a duration of 1-15000 seconds.

3. The anodic structure according to claim 1, wherein said microcontrol unit is configured:

to activate said at least one electric current sensor a first predefined number of times during each said actuation cycle;

to activate said wireless communication means a second predefined number of times during each said actuation cycle;

wherein said second predefined number is equal or lower than said first predefined number, wherein said wireless communication means send data collected from said at least one electric current sensor to at least one receiving means.

4. The anodic structure according to claim 3, wherein said periodic actuation cycle has a duration of 300-6000 seconds, wherein said microcontrol unit is configured to activate said at least one electric current sensor 1-10 times during each cycle, each activation of said at least one electric current sensor having a duration of less than 15 milliseconds.

5. The anodic structure according to claim 4, wherein said microcontrol unit is configured to activate said wireless communication means 1-3 times during each cycle.

6. The anodic structure according to claim 1, wherein said at least one electric current sensor is a Hall sensor.

7. The anodic structure according to claim 1, wherein said at least one electric current sensor is a temperature sensor.

8. The anodic structure according to claim 6, wherein said two slanted intermediate portions form an angle of 20-70 degrees with the vertical, and wherein said Hall sensor is positioned in correspondence of the upper third section of one of said slanted intermediate portion.

9. The anodic structure according to claim 1, further comprising visual or acoustic alert devices.

10. The anodic structure according to claim 1, wherein said wireless integrated device is covered by corrosion resistant materials chosen among plastics or resins.

11. A wireless integrated device for an anodic structure for metal electrodeposition, wherein the device houses:

a microcontrol unit;

an energy storage means;

at least one electric current sensor; and a wireless communication means;

said wireless integrated device being powered by said energy storage means, said wireless integrated device exhibiting a periodic actuation cycle comprising a sleep mode and an activation mode, said sleep mode having a total duration corresponding to 90.000%-99.998% of the duration of each periodic cycle, said microcontrol unit being configured to activate said at least one electric current sensor a first predefined number of times during each cycle, said microcontrol unit being configured to activate said wireless communication means a second predefined number of times during each cycle, said second predefined number being equal or lower than said first predefined number.

12. The wireless integrated device according to claim 11, wherein each periodic actuation cycle has a duration of 1-15000 seconds.

13. The wireless integrated device according to claim 11, wherein said at least one electric current sensor is a Hall sensor.

14. A data acquisition system for electric current signals in a metal electrodeposition plant comprising:

at least one electrolyser equipped with a plurality of elementary electrolytic cells, wherein each elementary electrolytic cell is equipped with one cathode and one anodic structure according to claim 1;

at least one computer;

wherein said at least one computer is in wireless connection with said anodic structure.

15. The data acquisition system according to claim 14, wherein said at least one computer is a local computer in wireless connection with 2 to 20 said anodic structures, said local computer further comprising means for receiving, elaborating and transmitting information from each said wireless integrated devices to a central computer.

16. The data acquisition system according to claim 15, further comprising at least one alert device providing a visual signal or an acoustic signal, or any combination thereof, wherein said at least one alert device is activated by said central computer or by said at least one local computer.

17. The data acquisition system according to claim 16, wherein said central computer or said at least one local computer performs the following steps:

acquisition and storage of data from each said anodic structure, wherein said data comprise at least one function of the electric current signal measured by said at least one electric current sensor;

filtering to said at least one function of the electric current signal with a linear filter;

activation of said at least one alert device in case said filtered function of the electric current signal lies outside a preset range of values.

18. The data acquisition according to claim 17, wherein said linear filter is a moving average filter.

19. The data acquisition according to claim 18, wherein said moving average filter is an exponential moving average filter.

* * * * *